US006015336A

United States Patent [19]

Kubota et al.

[11] Patent Number: 6,015,336

[45] Date of Patent: Jan. 18, 2000

[54] GRINDING APPARATUS

[75] Inventors: Osamu Kubota; Katsunori Arai; Yuji Sato; Takayuki Yui; Toshihisa Kanakubo, all of Matsuyama, Japan

[73] Assignee: Zexel Corporation, Tokyo, Japan

[21] Appl. No.: 09/197,414

[22] Filed: Nov. 23, 1998

[30] Foreign Application Priority Data

May 26, 1998 [JP] Japan ..... 10-161456

[51] Int. Cl.[7] ..... B24B 1/00; B24B 49/00

[52] U.S. Cl. ..... 451/251; 451/246; 451/249

[58] Field of Search ..... 451/62, 242, 246, 451/249, 251, 399

[56] References Cited

U.S. PATENT DOCUMENTS

| | | | |
|---|---|---|---|
| 3,344,559 | 10/1967 | Inaba et al. | 451/251 |
| 3,885,924 | 5/1975 | Marowsky | 451/251 |
| 4,099,349 | 7/1978 | Asano | 451/399 |
| 4,373,301 | 2/1983 | Parnum et al. | 451/62 |
| 4,498,259 | 2/1985 | Yamamoto et al. | 451/249 |
| 4,621,463 | 11/1986 | Komatsu et al. | 451/62 |
| 5,249,394 | 10/1993 | Griswold | 451/62 |
| 5,251,405 | 10/1993 | Clauss et al. | 451/62 |
| 5,355,633 | 10/1994 | Ishikawa et al. | 451/62 |
| 5,392,566 | 2/1995 | Wedeniwski | 451/62 |

*Primary Examiner*—Eileen P. Morgan
*Attorney, Agent, or Firm*—Wenderoth, Lind & Ponack, L.L.P.

[57] ABSTRACT

A grinding apparatus according to the present invention grinds a work having a plurality of non-circular work faces to be worked with a grindstone driven by a motor. The work faces are disposed at intervals. Distances between a grindstone unit, bearings and a gear train which are adjacent to each other, are substantially equal to a distance between adjacent work faces of the work. The gear train and the bearings can be respectively positioned between the adjacent work faces of the work in grinding. Therefore, it is possible to prevent interference of the gear train and the bearings with the work faces other than the work face which is being ground by the grinding wheel by a simple structure.

8 Claims, 6 Drawing Sheets

GRINDING APPARATUS

BACKGROUND OF THE INVENTION

The present invention relates to a grinding apparatus for grinding a work face of a work such as a cam using a grindstone.

In general, a camshaft (work) for driving plungers of an injection pump is provided with a plurality of cams that are disposed coaxially. Each of the cams has a recessed face for improving an engine characteristic, the recessed face being formed on a cam face of the cam. It may be preferable that a curvature of the recessed face is small.

As a process for forming such a cam face, there is an electric discharging machining or a grinding process using a belt or a grindstone. In the above working processes, the electric discharging machining suffers from problems of a poor mass-productivity and high cost due to wear of the tool. On the other hand, the grinding using the belt suffers from a problem that the belt is short wearing. In contrast, the grinding using the grindstone is superior in mass-productivity and cost of the tool.

As a grinder using a grindstone, there is an apparatus is disclosed in Japanese Patent Application Laid-open No. 60-213472, for example. This apparatus comprises a motor and a belt for transmitting a driving force of the motor to a grinding wheel.

There is another apparatus is disclosed in Japanese Patent Application Laid-open No. 8-243906. This apparatus comprises a grinding wheel directly mounted to a driving shaft of a motor and a tiltable mount for fixing the motor. The mount is inclined in grinding process of a cam of a camshaft so as to prevent interference with other adjacent cams.

However, when a diameter of the grinding wheel is decreased to grind the recessed face, the size of a contour of a driving mechanism for the grinding wheel is limited to prevent interference between the driving mechanism and the cam. Therefore, in the case of the former apparatus where the belt transmits the power of the motor to the grinding wheel, the belt can not transmit enough driving force to the grinding wheel.

The latter apparatus does not suffer from a problem of power transmission. However, in the case of the latter apparatus, it is necessary for the grinding process to relatively move the grinding wheel in the axial direction of the camshaft where the wide of the grinding wheel is substantially decreased to prevent interference with other adjacent cams. Therefore, the latter apparatus suffers from problems of a poor working accuracy and a short life of the grinding wheel.

SUMMARY OF THE INVENTION

It is an object of the present invention to provide a grinding apparatus for producing a large grinding power while preventing interference with a work in the grinding process of the work and extending life of a grindstone.

According to an aspect of the first invention, there is provided a grinding apparatus for grinding a work having a plurality of non-circular work faces to be worked, with a grindstone driven by a motor, the work faces being disposed at intervals each other. The apparatus comprises a grindstone unit having a grinding wheel thereof smaller than that of an arc defining a shape of eachwork face, a driving shaft connected to a shaft of the grinding wheel, a gear train for transmitting a driving force of the motor to the driving shaft, and a bearing for the driving shaft, characterized in that distances among the grindstone unit, the bearing and the gear train which are adjacent to each other are substantially equal to a distance between adjacent work faces of the work.

According to the first invention, when a non-circular work face of the work is ground, by driving of the motor a power is transmitted through the gear train to the grinding wheel to drive the grinding wheel so that the grinding wheel grinds the work face. As mentioned above, the distances among the grindstone unit, the bearing and the gear train which are adjacent to each other are substantially equal to the distance between adjacent work faces in grinding. Therefore, it is possible to position the gear train and the bearing between adjacent work faces so that interference of the gear train, the bearing and the grindstone unit with work faces other than the work face which is being ground with grinding wheel, is prevented. Thus, the interference can be easily prevented by a simple structure. Since the gear train transmits the driving force of the motor to the grinding wheel, a large grinding driving force can be reliably supplied to the grinding wheel. Also, it Us unnecessary to decrease the effective width of the grindstone by inclining the grinding wheel so that an extreme wear of the grinding wheel can be prevented, thereby extending a life of the grinding wheel.

The gear train includes preferably helical gears. If the gear train includes the helical gears, it can smoothly transmits the driving force, and vibration and noise of the apparatus can be decreased.

It is preferable that each of the work faces of the work has the concave portion and the radius of the grinding wheel is smaller than that of a curvature of the concave portion on the work face. When the concave portion of the work face is ground, the grindstone unit is moved close to the work to advance the grinding wheel toward the work face. Even in this case, since the grindstone unit, the bearing and the gear train of the grinding apparatus are respectively positioned between the adjacent work faces, it can be effectively prevented that the other work faces are in contact with the grindstone unit, the bearing and the gear train.

The work is preferably used for a fuel injection pump as a camshaft- for driving a plurality of plungers of the pump. In general, the camshaft includes a plurality of cams disposed coaxially. Each of the cams is formed with a concave portion on the cam face (work face) for improving an engine characteristic, and the concave portion has a small curvature. Therefore, the camshaft is suitable to be worked by the grinding apparatus according to the invention.

According to an aspect of a second invention, there is provided a grinding apparatus for grinding a work having a plurality of non-circular work faces to be worked with a grindstone driven by a motor, the work faces being disposed at intervals. The apparatus comprises a grindstone unit having a grinding wheel with a radius thereof smaller than that of an arc defining a shape of each work face, a driving shaft connected to a shaft of the grinding wheel, a gear unit including a gear train for transmitting a driving force of the motor to the driving shaft and a gearbox for covering the gear train, and a bearing for the driving shaft, characterized in that distances among the grindstone unit, the bearing and the gearbox which are adjacent to each other are substantially equal to a distance between the adjacent work faces of the work, and the gear unit further includes spraying means for spraying lubricating oil on the gear train.

According to the second invention, similarly to the above first invention, since the gearbox and the bearing can be respectively positioned between the adjacent work faces in grinding, interference mention above can be easily prevented by a simple structure. Because the gear train transmits the driving force of the motor to the grinding wheel, the large driving force can be reliably supplied to the grinding wheel. Also, since it is unnecessary to incline the grinding wheel, the extreme wear of the grinding wheel can be prevented, thereby extending the life of the grinding wheel. Furthermore, the lubricating oil is sprayed on the gear train in the gearbox. Therefore, a resistance due to the sprayed lubricating oil is small a compared with a case in which the gear train is immersed in the lubricating oil, and the spraying can increase a pressure in the gearbox to prevent entering of chips or dust into the gearbox.

In the second invention, as mentioned above, the gear train includes preferably the helical gear. It is preferable that each of the work faces of the work has the concave portion and the radius of the grinding wheel is smaller than the radius of a curvature of each concave portion of the work face. Further, the work Is preferably used for the fuel injection pump as the camshaft for driving the plurality of plungers of the pump.

DESCRIPTION OF THE PREFERRED EMBODIMENT

Figure 1:
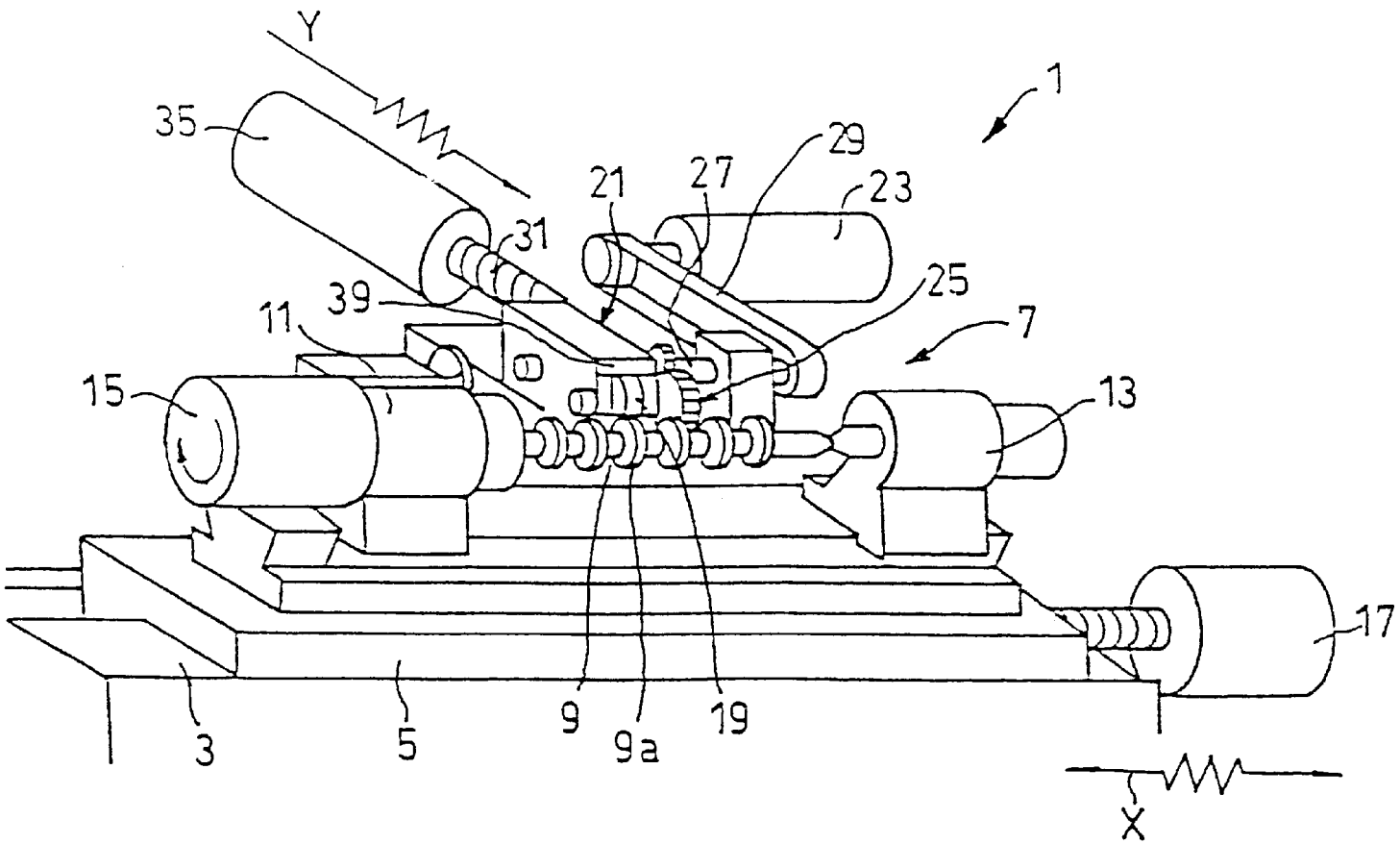
FIG. 1 is a perspective view showing a schematic structure of a grinding apparatus according to the invention.

An embodiment of the present invention will be specifically described below, with reference to accompanying drawings (FIGS. 1 to 6). As shown in FIG. 1, a grinding apparatus 1 comprises a base 3, a table 5 movably mounted on the base 3, and a grinding unit 7. Aheadstock 11 for supporting a camshaft 9 as a work and a tailstock 13 are mounted on the table 5. The headstock 11 is provided with a first motor 15 for rotating the camshaft 9, and the base 3 is provided with a second motor 17 for feeding the table 5 in a direction of an arrow X.

The grinding unit 7 comprises a grindstone unit 21 containing a grinding wheel 19, a third motor 23 for driving the grinding wheel 19, and a gear train 25. A transmitting shaft 27 transmits a received driving force to the gear train 25. The driving force of the third motor 23 is transmitted to the transmitting shaft 27 through a belt 29. In the present embodiment, since the driving force of the third motor 23 is transmitted to the grinding wheel 19 through the gear train 25, the driving force of the third motor 23 can be reliably transmitted.

Figure 2:
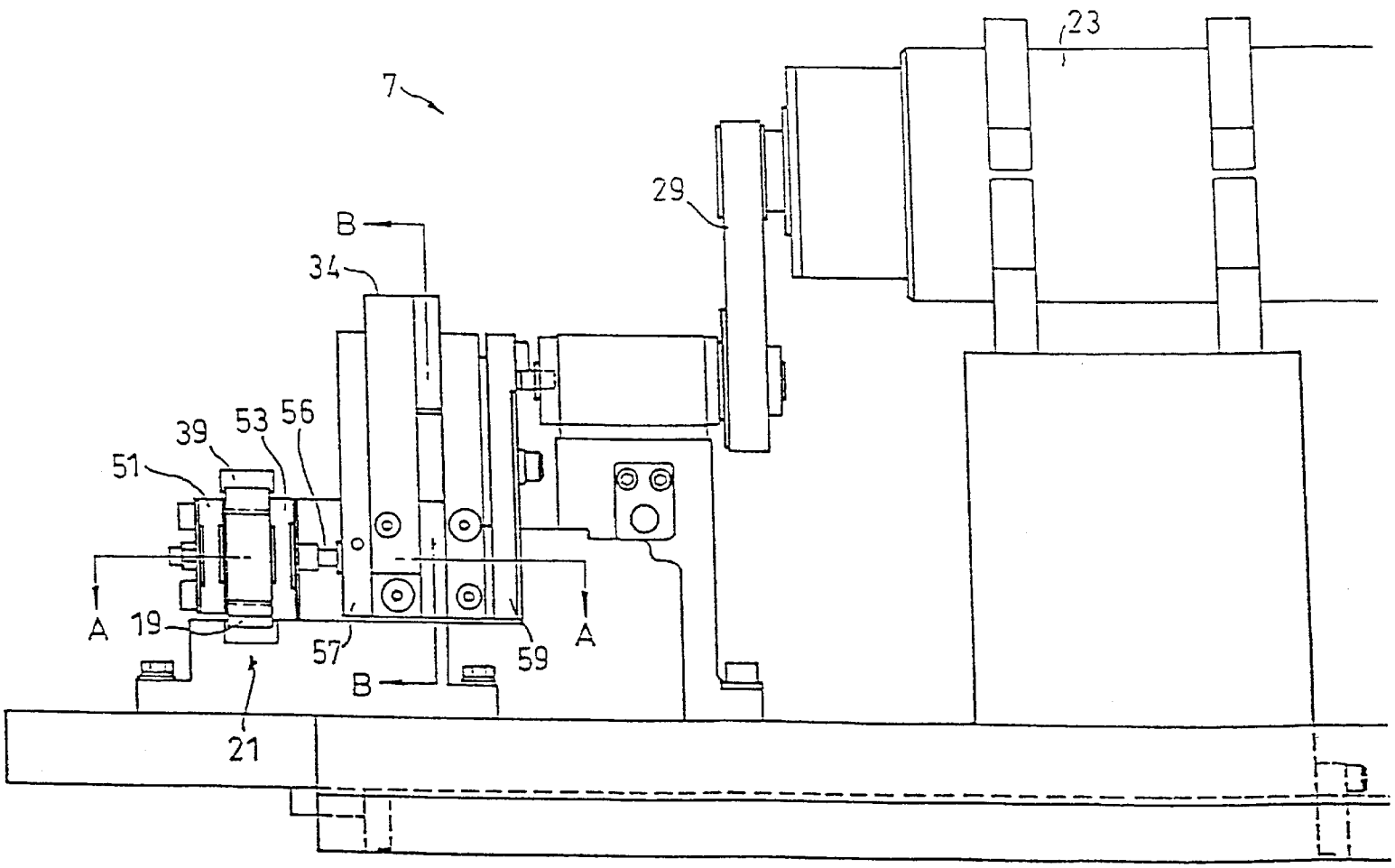
FIG. 2 is a front view of a grinding unit.
Figure 3:
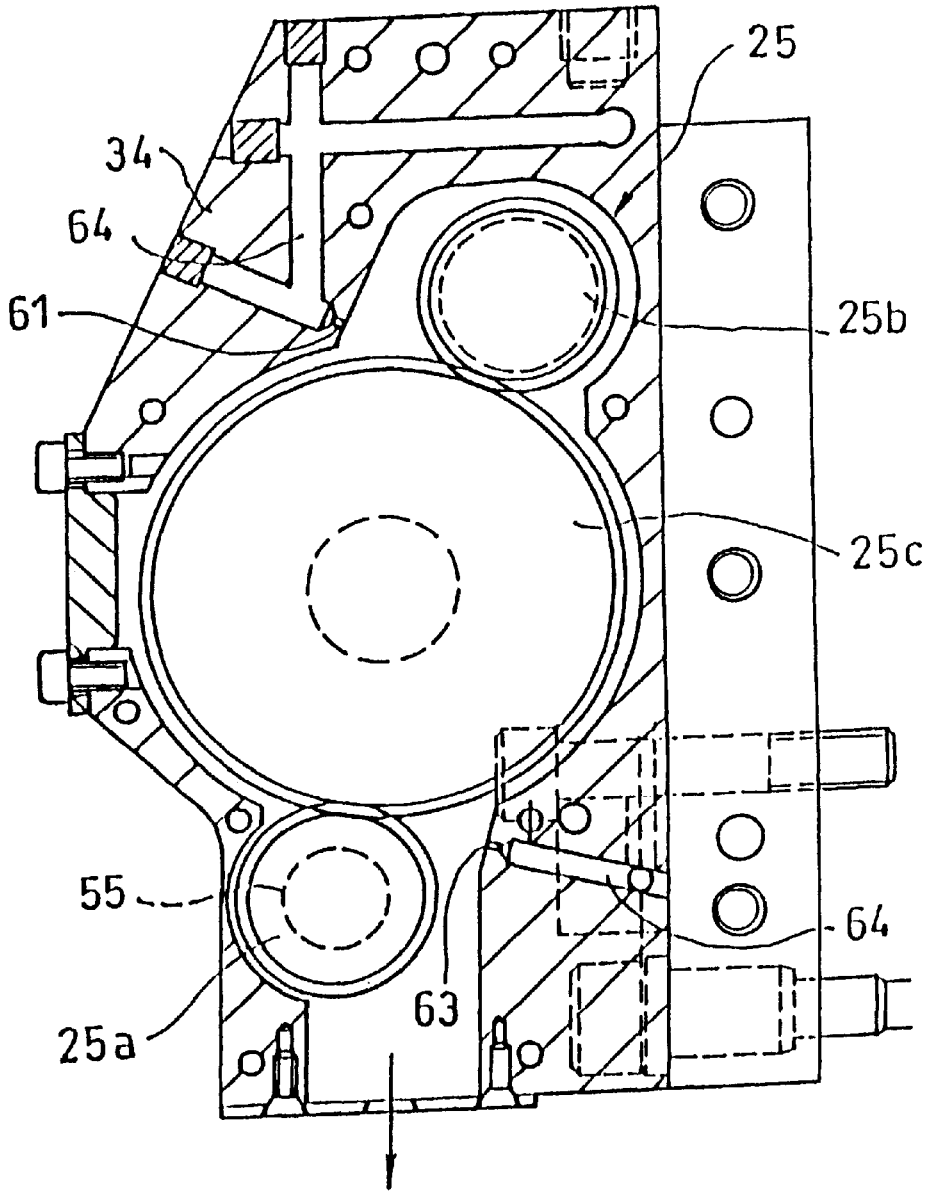
FIG. 3 is a sectional view taken along a line B—B of FIG. 2.

Although a gearbox for housing the gear train 25 is omitted in FIG. 1 for better understanding of the structure, the gear Drain 25 is housed in a gearbox 34 in the embodiment, as shown in FIGS. 2 and 3.

The grinding unit 7 comprises a ball screw 31 and a fourth motor 35 for driving the ball screw 31 for rotation. The fourth motor 35 drives the grindstone unit 21 for movements toward and away from the camshaft 9 in a direction of an arrow Y in FIG. 1.

Figure 4A:
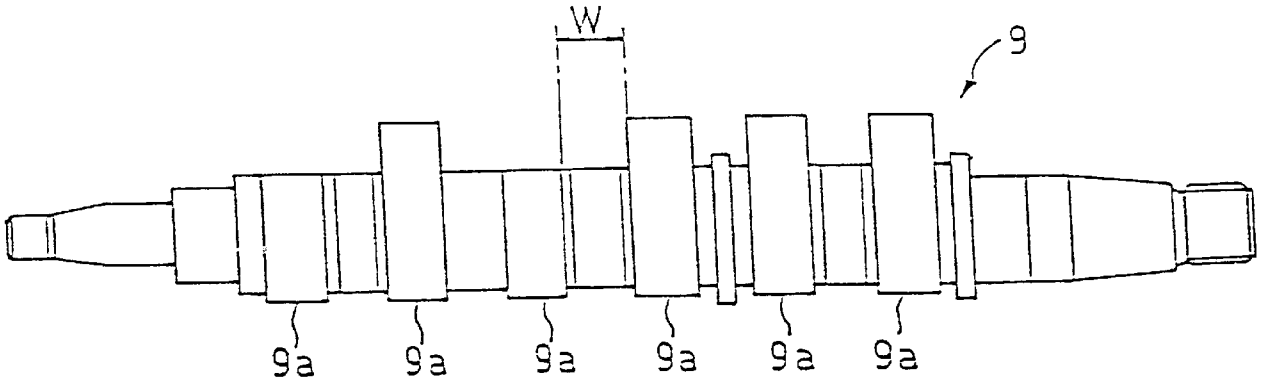
FIGS. 4(*a*) and 4(*b*) show a camshaft, wherein FIG. 4(*a*) is a front view of the camshaft and FIG. 4(*b*) is a side view showing a relationship between a cam and a grinding wheel.
Figure 4B:
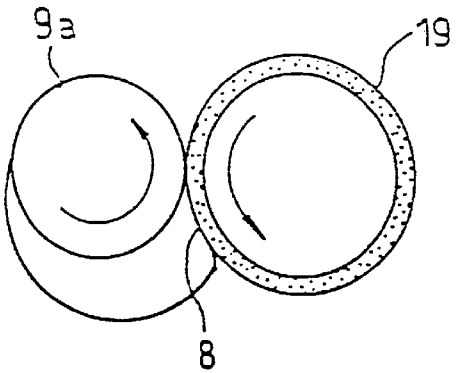

The camshaft 9 as the work will be described. The camshaft 9 is used for reciprocating plungers of an injection pump. As shown in FIGS. 1 and 4(*a*), for example six cams 9a, are coaxially disposed at predetermined intervals. Each of the cams 9*a* has a concave face 8 having a small curvature in order to improve an engine characteristic. FIG. 4(*a*) is a front view of the camshaft 9 and FIG. 4(*b*) shows a state in which the grinding wheel 19 is grinding the concave face 8.

Figure 5:
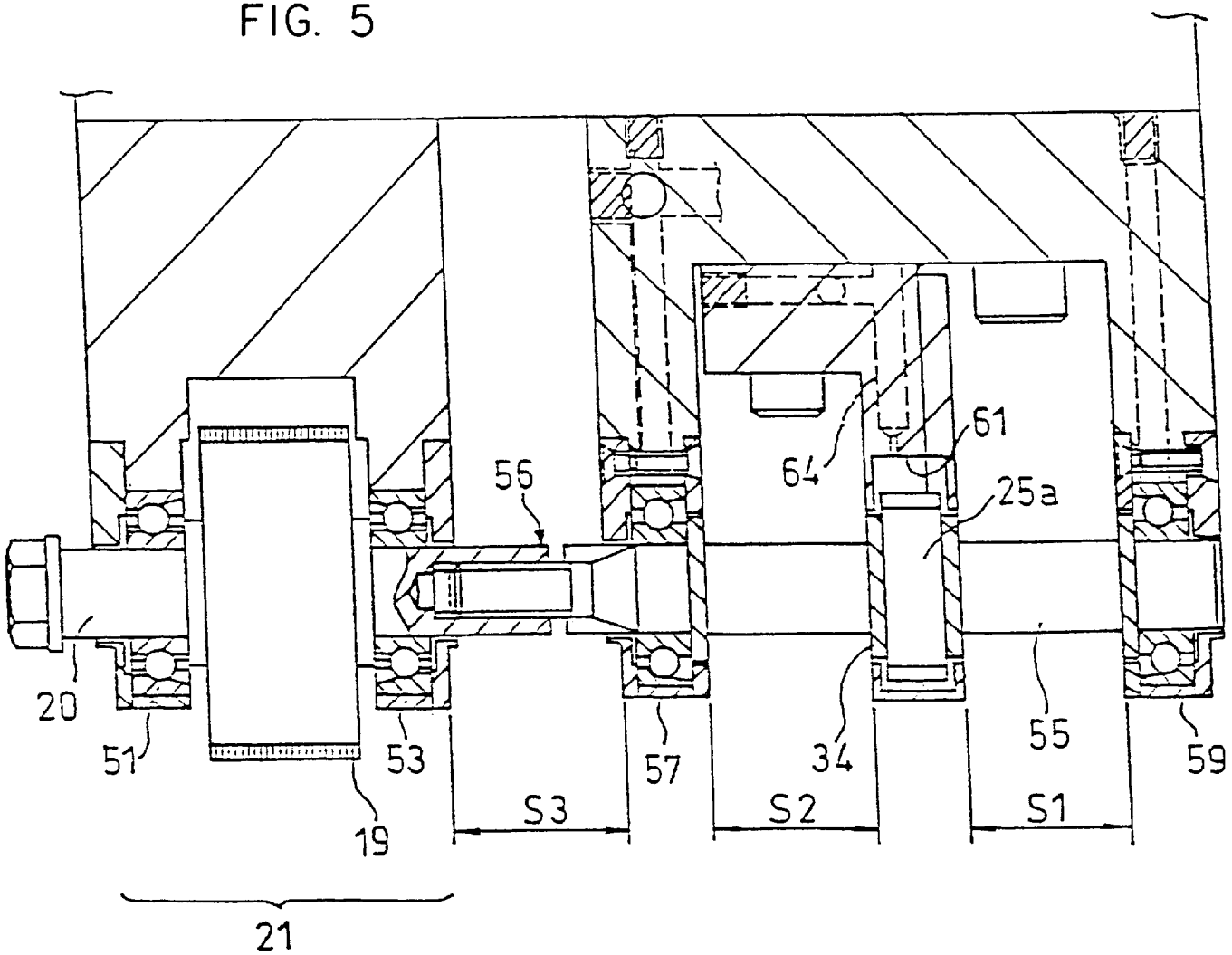
FIG. 5 is a sectional view taken along a line A—A of FIG. 2.

The grindstone unit 21 comprises the grinding wheel 19 and a cover 39 for covering the grinding wheel 19, as shown in FIG. 5. The grinding wheel 19 is projected toward the camshaft 9. A radius of the grinding wheel 19 is smaller than that of an arc defining a shape of the concave face 8. A shaft 20 of the grinding wheel 19 is supported by bearings 51 and 53. An end of the shaft 20 of the grinding wheel 19 is connected to a shaft 55 of an output gear 25*a* (see FIG. 3) of the gear train 25 through a coupling portion 56, that is, a spline joint to transmit a driving force. The output gear 25*a* is a terminal gear of the gear train 25.

The shaft 55 of the output gear 25*a* is supported by bearings 57 and 59. These bearing are projected toward the camshaft 9.

The gear train 25 is housed in the gearbox 34 and includes three gears, i.e., an input gear 25*b*, the output gear 25*a* and an idle gear 25*c*, as shown in FIG. 3. The gears 25*a*, 25*c* and 25*b* are meshed each other in order. Each of the gears is a helical gear so that the gear train 25 can smoothly transmit the driving force and decrease vibration or noise.

Provided in the gearbox 34 are a first oil spraying hole (lubricating oil spraying means) 61 for spraying oil on a meshing portion of the input gear 25*b* with the idle gear 25*c*, and a second oil spraying hole (lubricating oil spraying means) 63 for spraying oil on a meshing portion of the idle gear 25*c* with the output gear 25*a*. Oil is sprayed in the gearbox 34 through the first and second oil spraying holes 61 and 63 to lubricate the gears, and to increase a pressure in the gearbox 34, thereby preventing chips or dust generated outside the gearbox 34 from entering into the gearbox 34. The oil is supplied to the first and second oil spraying holes 61 and 63 through passages 64.

Next, a relationship between distances among the grindstone unit 21, the gearbox 34 of the gear train 25, and the bearings 57 and 59 and a distance between adjacent cams 9*a*, 9*a* of the camshaft 9 will be described. When a distance between adjacent cams 9*a*, 9*a* of the camshaft 9 is referred to as W, as shown in FIG. 4, a distance between the bearing 59 and the gear box 34 as S1, a distance between the gearbox 34 and the bearing 57 as S2, and a distance between the bearing 57 and the grindstone unit 21 as S3, as shown in FIG. 5, the distances W, S1, S2, and S3 are substantially equal to each other.

By setting the distances S1, S2, and S3 at same value substantially equal to the distance W between the adjacent cams 9*a*, 9*a*, the bearings 57 and 59 and the gearbox 34 are respectively positioned between adjacent cams 9*a*, thereby preventing interference of the bearings 57 and 59 and the gear box 34 with the camshaft 9 in grinding the cam 9*a*. Especially, in the present embodiment, the radius of the grinding wheel 19 is smaller than that of the curvature of the concave face 8 of the cam 9*a*. Therefore, even if the grindstone unit 21 is moved close to the camshaft 9 to grind the concave face 8 (see FIG. 4(*b*) ), the bearings 57 and 59 and the grindstone unit 21 which are projecting toward the camshaft 9 respectively can be positioned between the adjacent cams 9*a*. Thus, it is possible to effectively prevent interference of the cams 9*a* with the bearings 57 and 59 and the grindstone unit 21.

Next, an operation of the present embodiment will be described.

The headstock 11 and the tailstock 13 support the camshaft 9, and the grindstone unit 21 is operated to grind the cams 9*a*. When the cam 9 is supported, the bearings 57 and 59 and the grindstone unit 21 are respectively positioned between the adjacent cams 9*a*.

If the third motor 23 is driven in this state, a driving force of the motor 23 is transmitted through the belt 29, the transmitting shaft 27, the gear train 25 and the output shaft 55 to the shaft 20 of the grinding wheel 19, thereby grinding the cam 9*a*.

Figure 6:
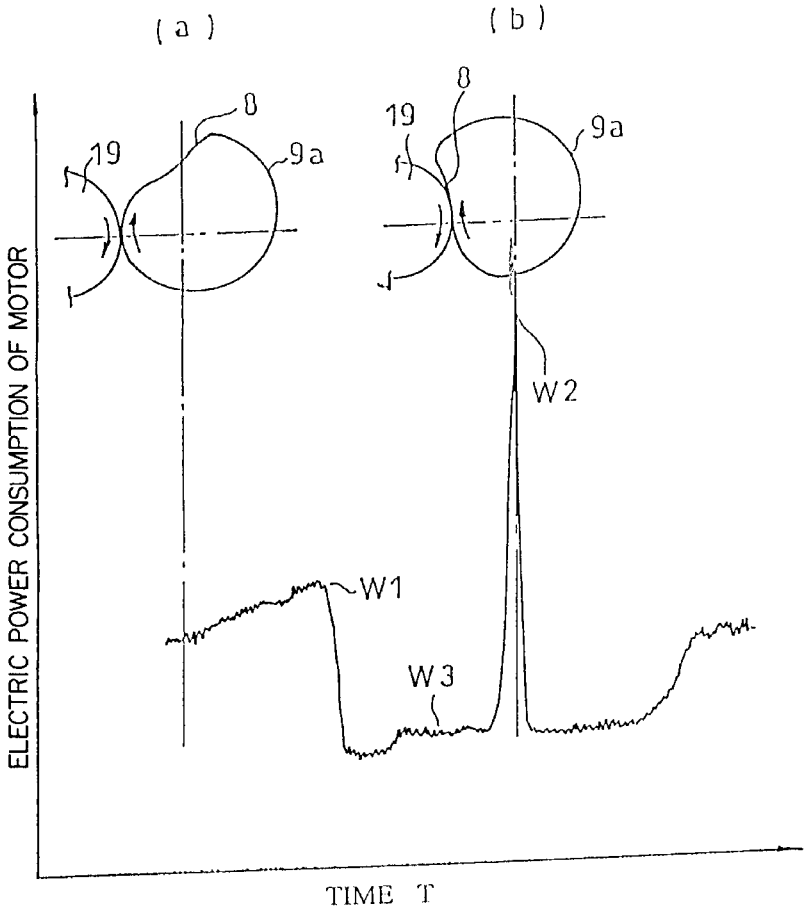
FIG. 6 is a graph showing a variation of a power consumption of a motor over a period of time in grinding of the cam.

The third motor 23 consumes an electric power of W1 at the time of grinding a convex face portion of the cam 9*a* as shown in FIG. 6(*a*). At the time of grinding the concave face 8, as shown in FIG. 6(*b*), a rotation speed of the cam 9*a* is decreased as compared with that in grinding of the projecting face portion, and an electric power consumption is decreased to be W3. However, a large electric power of W2 as compared with the electric power of W1 is temporary consumed in grinding.

In FIGS. 6(*a*) and 6(*b*), the electric power consumption (load) of the motor 23 is plotted in a vertical axis and time is plotted in a horizontal axis. As apparent from FIGS. 6(*a*) and 6(*b*), the electric power consumption of the motor 23 is increased in grinding the concave face 8, such that the electric power consumption varies suddenly. However, since the present embodiment comprises the gear train 25 for transmitting the driving force, it is possible to reliably transmit the power, even if the grinding power become large or the load varies suddenly.

Furthermore, as a result of an actual grinding, time taken to work the cam 9*a* was not longer than that in conventional art.

According to the present embodiment, since the grindstone unit 21 including the grinding wheel 19 can be made compact and decreased in weight, an inertial force is small and a motion performance (accelerating characteristic) of the shaft 20 of the grinding wheel 19 is well.

Also, the present embodiment can be applied to a broad range of steps from a rough grinding to a finishing grinding by selecting the grinding wheel 19. Moreover, it is possible to easily produce the apparatus according to the present embodiment only by changing an arrangement of a structure of a general grinder.

Further, the present embodiment does not require a mechanical stage shift unlike the electric discharging machining, and can work not only the concave face but also various cams such as a convex cam or a tangential cam, only by changing a program.

What is claimed is:

1. A grinding apparatus for grinding a work having a plurality of non-circular work faces to be worked with a grindstone driven by a motor, the work faces being disposed at intervals, said apparatus comprising;

a grindstone unit having a grinding wheel with a radius thereof smaller than that of an arc defining a shape of each work face;

a driving shaft connected to a shaft of the grinding wheel;

a gear train for transmitting a driving force of the motor to said driving shaft; and a bearing for said driving shaft;

characterized in that distances between, said grindstone unit, said bearing and said gear train which are adjacent to each other are substantially equal to a distance between adjacent work faces of said work.

2. A grinding apparatus according to claim 1, wherein said gear train includes helical gears.

3. A grinding apparatus according to claim 1, wherein the work faces of each of said work include concave portion, and a radius of the grinding wheel is smaller than that of a curvature of the concave portion.

4. A grinding apparatus according to claim 1, wherein said work is used for a fuel injection pump as a camshaft for driving a plurality of plungers of said fuel injection pump.

5. A grinding apparatus for grinding a work having a plurality of non-circular work faces to be worked with a grindstone driven by a motor, the work face being disposed at intervals, said apparatus comprising;

a grindstone unit having a grinding wheel with a radius thereof smaller than that of an arc defining a shape of each work face;

a driving shaft connected to a shaft of the grinding wheel;

a gear unit having a gear train for transmitting a driving force of said motor to said driving shaft and a gearbox for covering the gear train; and a bearing for said driving shaft;

characterized in that distances between said grindstone unit, said bearing, and said gearbox which are adjacent to each other are substantially equal to a distance between adjacent work faces of said work, and said gear unit includes a lubricating oil spraying means for spraying lubricating oil on the gear train.

6. A grinding apparatus according to claim 5, wherein the gear train includes helical gears.

7. A grinding apparatus according to claim 5, wherein each of the work face of said work include a concave portions and a radius of the grinding wheel is smaller than that of a curvature of the concave portion.

8. A grinding apparatus according to claim 5, wherein said work is used for a fuel injection pump as a camshaft for driving a plurality of plungers of said fuel injection pump.

* * * * *